US006290600B1

(12) United States Patent
Glasson

(10) Patent No.: US 6,290,600 B1
(45) Date of Patent: Sep. 18, 2001

(54) ELECTRONIC GAME WITH MOVING BONUS SYMBOL

(76) Inventor: Naomi Glasson, Gumpendorfer Strasse 83/1/29, Vienna (AT)

( * ) Notice: Subject to any disclaimer, the term of this patent is extended or adjusted under 35 U.S.C. 154(b) by 0 days.

(21) Appl. No.: 09/391,346

(22) Filed: Sep. 8, 1999

(51) Int. Cl.[7] ..... A63F 9/24
(52) U.S. Cl. ..... 463/20; 463/13; 273/143 R
(58) Field of Search ..... 463/13, 16–20, 463/25–27, 31, 35; 273/143 R, 138.1, 138 A

(56) References Cited

U.S. PATENT DOCUMENTS

| | | | | |
|---|---|---|---|---|
| 4,836,546 | * | 6/1989 | DiRe et al. | 273/138 A |
| 5,449,173 | * | 9/1995 | Thomas et al. | 273/143 R |
| 5,772,506 | * | 6/1998 | Marks et al. | 463/13 |
| 5,778,573 | * | 8/1998 | Baerlocher et al. | 463/16 |
| 6,033,307 | * | 3/2000 | Vancura | 463/20 |
| 6,059,289 | * | 5/2000 | Vancura | 273/143 R |
| 6,089,977 | * | 7/2000 | Bennett | 463/20 |

FOREIGN PATENT DOCUMENTS

| | | | | |
|---|---|---|---|---|
| 0984407A2 | * | 8/2000 | (EP) | G07F/17/32 |
| 9-122315 | * | 9/1997 | (JP) | A63F/7/02 |

* cited by examiner

*Primary Examiner*—Michael O'Neill
*Assistant Examiner*—Steven Ashburn
(74) *Attorney, Agent, or Firm*—Philip J. Anderson; Anderson & Morishita

(57) ABSTRACT

An electronic game and method are set forth wherein if a player obtains a bonus symbol on one reel of the gaming device and a landing symbol on an adjacent reel a bonus sequence is triggered. When the bonus sequence is triggered, a jumping symbol moves to the landing symbol. If the next reel includes a landing symbol, the feature symbol continues to move across the display. If any reel does not display a landing symbol, that reel is re-spun in an attempt to obtain a landing symbol. The player is awarded a bonus based upon the number of reels the feature symbol can progress through. If the symbol can progress through all the reels, a jackpot bonus is awarded.

15 Claims, 5 Drawing Sheets

ELECTRONIC GAME WITH MOVING BONUS SYMBOL

FIELD OF THE INVENTION

The present invention relates to electronic games commonly referred to as slot machines. More particularly it relates to slot machines of the type which have a bonus sequence.

BACKGROUND

Slot machines are well known gaming devices. In the past they have been embodied as first mechanical and later electromechanical devices having three or more reels. Each reel includes about its periphery a plurality of symbols (and blanks). When play is initiated as by inserting a wager and pulling a handle, the reels are spun eventually slowing to present symbols or blanks at a payline. If the combination of symbols is one of a predetermined schedule of winning outcomes, the player receives a reward. If the outcome is a losing outcome, the player loses their wager.

Recently it has been known to provide video displays controlled by a processor which simulates spinning reels and the presentation of winning or losing outcomes. Furthermore it has been known to provide these devices with bonus sequences which are triggered by the player obtaining certain outcomes during play of the primary game. One such game is a game wherein five reels are displayed. The player makes a wager to enable from one to five or more paylines. When play is prompted, the processor simulates the spinning of the reels and the eventual presentation of outcomes for each enabled payline. If the player has a winning outcome on any enabled payline they receive a reward. If the player receives a bonus enabling outcome, the display switches to a bonus display. In one machine the display is of a barnyard where the player is requested to select one of five displayed pigs. Upon making the selection, the display displays a farmer washing the mud off of the pig to reveal a bonus. In another game five fishermen are shown and the player is prompted to select one. The display shows the selected fisherman reeling in a fish to display the bonus.

These bonus game have gained popularity in casinos.

In another type of game, when the player obtains a predetermined outcome during play of the game, a sequence is initiated wherein a wild symbol marches through the display creating different combinations and different payouts. One such game is as described in Australian Patent AU-B43613/97 published Feb. 5, 1998 by Bennett and titled "Slot Machine With Roaming Wild Symbol".

Bonus games are, as stated above, popular among players. However, one drawback is that, in one type of machine, the player only gets to select symbols as a means for randomly selecting a bonus. The player, by obtaining a bonus enabling outcome knows they are going to obtain a bonus, he just does not know how much. There is no means by which the player might expect to increase his bonus during play or presentation of the bonus sequence. With roaming wild symbols, the prize of the feature depends on combinations created by the roaming wild symbol while moving from position to position.

In Hooker, U.S. Pat. No. 4,184,683, a slot machine is set forth where the player can hold a reel for the next spin of the remaining reels in an effort to obtain a winning outcome on a payline. This game does not relate to bonuses in relation to the play of a primary game.

There is a need for a slot machine game and method which overcomes the drawbacks noted above, which provides for a bonus sequence and which provides the player during the bonus sequence with a chance to increase the bonus to be awarded.

SUMMARY

There is, therefore, set forth according to the present invention, an improved electronic gaming device of the type including a display, means for accepting a wager, a processor programmed to, when prompted, control the display to display at least three reels each in a spinning mode concluding at a stopped mode whereat a plurality of reel symbols are displayed on said reels selected from the data structure defining a winning or a losing outcome based upon the combination of symbols displayed on the reels and means for issuing a reward to the player when a winning outcome is obtained. One or more paylines are provided with the symbols or blanks aligned there along defining the outcome(s). The arrangement of symbols scattered anywhere on the display can also define additional winning outcomes. The processor is programmed, configured and adapted to sense the occurrence of a predetermined bonus triggering event. While the triggering event may be external to the device such as a signal from another processor, in the preferred embodiment the triggering event is the player obtaining at the display one or a combination of symbols. For example the triggering event may be the display of a feature symbol on one reel and the display of a landing symbol on another, adjacent reel. In response to sensing said triggering event the processor is adapted to initiate a bonus sequence and control the display to display a designated symbol moving from a first position to at least one or more landing positions on the display. Means are provided for issuing a bonus award based upon the number of landing positions moved to by the designated symbol.

The designated or landing symbol may be a game symbol which can be used to form a winning combination during play of the underlying game.

In a preferred embodiment, the processor controls the display to display a designated feature symbol, when selected, at only the left most reel in the display presentation and any selected landing symbols on the other reels. In the most preferred embodiment, the triggering event is when the symbols selected and displayed display the feature symbol at the left most reel and a landing symbol on the adjacent reel. The feature symbol would therefore be shown to move to a landing position associated with the landing symbol. If landing symbols are displayed for all reels the feature symbol moves sequentially from left to right from one landing symbol to the next. Based upon how many reels the feature symbol can progress through the player wins a bonus award. If there is no landing symbol on a reel, the processor senses this condition and in one embodiment controls the display to display a bonus terminating sequence such as the feature symbol frog falling or jumping from the display. According to another embodiment, if the triggering event has occurred and the processor senses that the next adjacent reel does not include a landing symbol, the processor reselects symbols for that reel and displays that reel re-spinning to display the newly selected symbols including a landing symbol, if any. If the re-selection includes a landing symbol, the feature symbol moves to that reel and the foregoing is repeated for the next reel. If not, the termination sequence is initiated.

In the preferred embodiment, if the feature symbol can progress across the display to all reels, the processor initiates a celebration sequence whereupon a celebration image is displayed to interact with the feature symbol as by showing a Princess kissing the frog feature symbol.

Still further the feature symbol and landing symbols can be incorporated into the theme of the game by providing jumping frogs, insects, fish, dogs, athletes or the like.

BRIEF DESCRIPTION OF THE DRAWINGS

These and other features and advantages will become appreciated as the same becomes better understood with reference to the claims, description and drawings wherein:

DESCRIPTION

Figure 1:
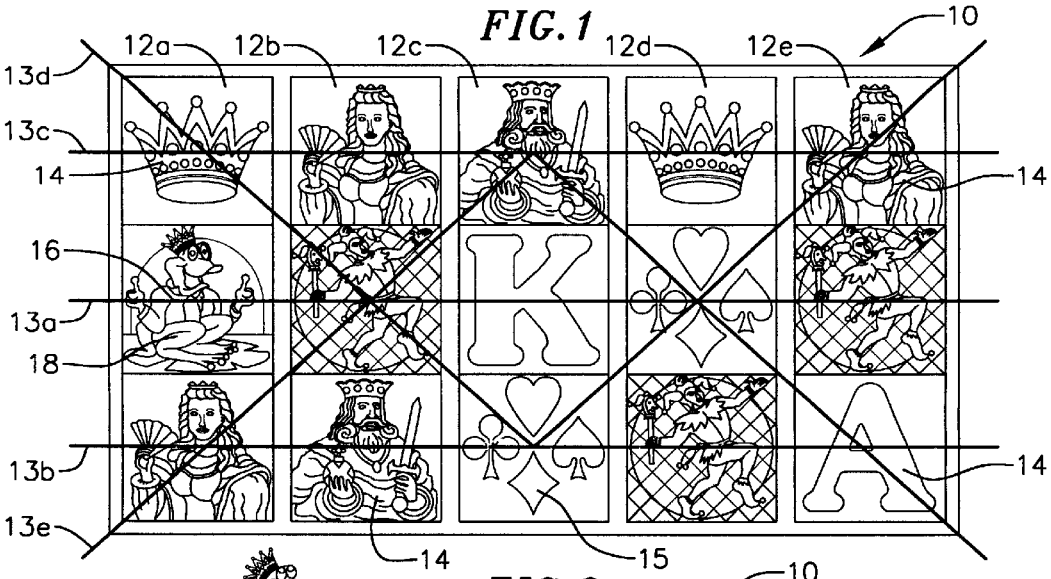
FIGS. 1 through 12 show various displays during the play of the game, with only FIG. 1 showing the various paylines for the game.

Turning to the drawings, FIGS. 1–12 illustrate sample displays for a device according to the present invention. With reference to FIG. 1, there is shown a display 10 which is controlled by a processor (not shown) to show five reels 12*a–e*, each of the reels 12*a–e* showing one or more symbols 14.

To play the game according to the present invention, a player makes a wager which may be coins, tokens, cash script, credits or the like in a manner known in the art. The player then prompts the play of the device whereby the processor controls the display 10 to simulate each of the reels 12*a–e* in a spinning mode giving the appearance that the reels 12*a–e* are spinning, the reels 12*a–e* eventually stopping to provide one or more outcomes for the play of the primary game. As shown in FIG. 1, the reels 12*a–e* are shown in the stopped position where the outcome is defined. One or more paylines 13*a–e* may be provided as is well known in the art for the display 10. Depending upon the combinations of symbols 14 or blanks (locations on the reels 12*a–e* which have no symbols 14) aligned along any enabled payline 13*a–e*, or upon the combination of scattered symbols 15 any where on the display 10 (i.e. alignment of scattered symbols 15 along any payline 22*a–e* is not required), the player obtains winning or losing outcomes for the game. This feature is known in the art.

When the reels 12*a–e* have stopped to define the outcome (s) for the primary game, the processor senses the positions of the symbols 14 in relation to any established paylines 13*a–e* and compares the combinations of symbols 14 along those paylines 13*a–e* to a schedule of preestablished, winning combinations. If a player has obtained a winning combination along any payline 13*a–e*, the player is issued an award. The processor also senses the position of the scattered symbols 15 and compares the combination of these symbols 15 on the display 10 to a schedule of pre-established scattered winning combinations. If the player does not have a winning combination along a payline 13*a–e*, for that payline 13*a–e*, the player receives no award. If the player does not have a winning combination for scattered symbols 15, for scattered combinations, the player receives no award. Again, this concept is known in the art.

The primary or basic game according to the present invention is adapted to be played serially, with a player inserting a new wager and prompting the device to play another "hand."

Figure 2:
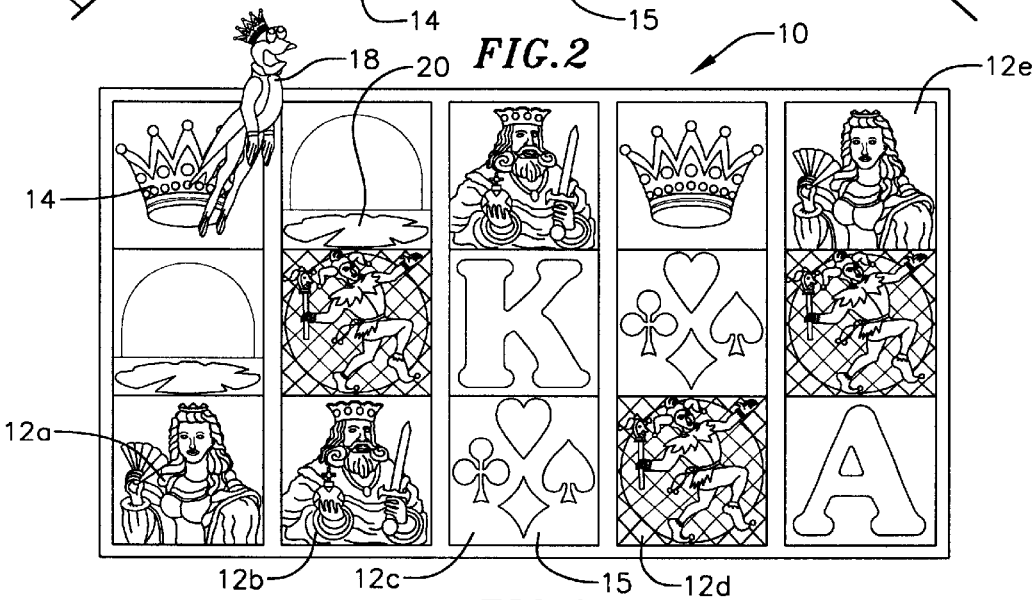

With reference to FIG. 1, there is shown provided on one or more of the reels 12*a–e* a designated bonus symbol 16 shown as a fanciful depiction of a frog sitting on a lily pad. According to the preferred method for playing the game of the present invention, this bonus symbol 16 only appears on the left-most reel 12*a* on the display 10; however, it should be understood that the bonus symbol 16 could be provided on other reels 12*b–e* as desired. Also preferably, the bonus symbol 16 includes a feature symbol 18 shown as the frog. With reference to FIG. 2, there is shown on reel 12*b*, a landing symbol 20 depicted in FIG. 2 as a lily pad. In the preferred embodiment, each of the reels 12*b–e* is provided virtually with one or more landing symbols 20.

The bonus symbol 16 and landing symbols 20 can be symbols for the game in that they can form in whole or in part a winning combination for the primary game.

The play of the game according to the present invention will now be described.

To play the game, the player makes a wager which can be from a minimum amount of one credit, coin or token to a maximum amount provided for the game. The number of paylines 13*a–e* provided may dictate the maximum amount which can be wagered. For the example shown on the FIG. 1 the game display 10 has five paylines 13*a–e* representing three horizontal lines cutting across all of the reels 12*a–e* as well as two reflecting diagonal lines. The player, enables the paylines 13*a–e* by increasing wagers. For example, if the player wagers five units or credits, all five paylines 13*a–e* would be enabled. If the player wagers a single credit or unit, only payline 13*a* would be enabled. As a further feature of the game, the player may be able to wager multiple credits or units for each of the paylines 13*a–e*. The player prompts play as by depressing a button, touching a touch screen input device or the like. For purposes of the following description, it shall be assumed that the player makes a maximum wager permitted by the device, e.g. five units times five paylines or twenty-five units, for each hand of play.

After the player has made the wager, the device is enabled whereupon the processor randomly selects from a data structure the symbols 14 and any bonus symbol(s) 16 or landing symbol(s) 20 which may be displayed at the display 10. The processor retrieves the selected data and controls the display 10 to display the reels 12*a–e* in a first mode as spinning and thereafter to display the reels 12*a–e* in a stopped condition to display the selected outcomes for each of the paylines 13*a–e*. Depending upon the symbols 14 obtained along the paylines 13*a–e*, for paylines 13*a–e*, the player either loses or obtains a reward. Depending upon the scattered symbols 15 obtained on the display 10, for scattered symbols 15, the player either loses or obtains a reward. For purposes of explanation only, the following is a schedule of winning outcomes for the game shown in the drawings.

TABLE 1

| SYMBOL | NUMBER OF SYMBOLS ALONG A PAYLINE | PAYOUT |
|---|---|---|
| Jester | 5 | 5000 |
| | 4 | 1000 |
| | 3 | 100 |
| | 2 | 10 |
| | 1 | 5 |
| King | 5 | 500 |
| | 4 | 150 |
| | 3 | 25 |
| | 2 | 5 |
| Queen | 5 | 500 |
| | 4 | 150 |
| | 3 | 25 |
| | 2 | 5 |
| Prince Crown | 5 | 250 |
| | 4 | 100 |

TABLE 1-continued

| SYMBOL | NUMBER OF SYMBOLS ALONG A PAYLINE | PAYOUT |
|---|---|---|
| | 3 | 20 |
| Ace | 5 | 200 |
| | 4 | 40 |
| | 3 | 15 |
| K/Q | 5 | 150 |
| | 4 | 25 |
| | 3 | 10 |
| Jack/10 | 5 | 100 |
| | 4 | 20 |
| | 3 | 5 |
| | Number of symbols Anywhere on the display | |
| Scatter Suits | 5 | 100 |
| | 4 | 15 |
| | 3 | 2 |

It should be understood that any other schedule of symbols could be used for the play of the game.

Figure 3:
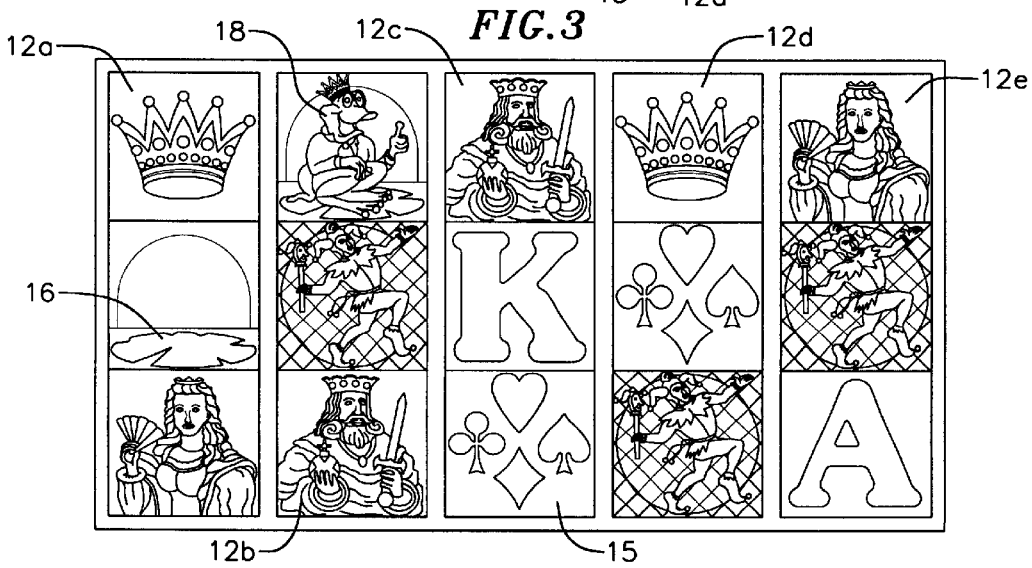
Figure 4:
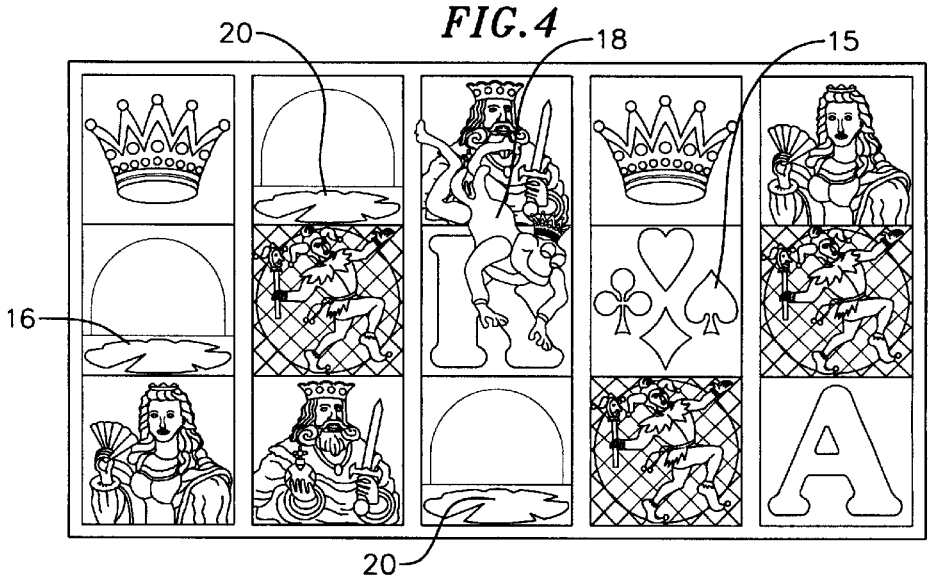
Figure 5:
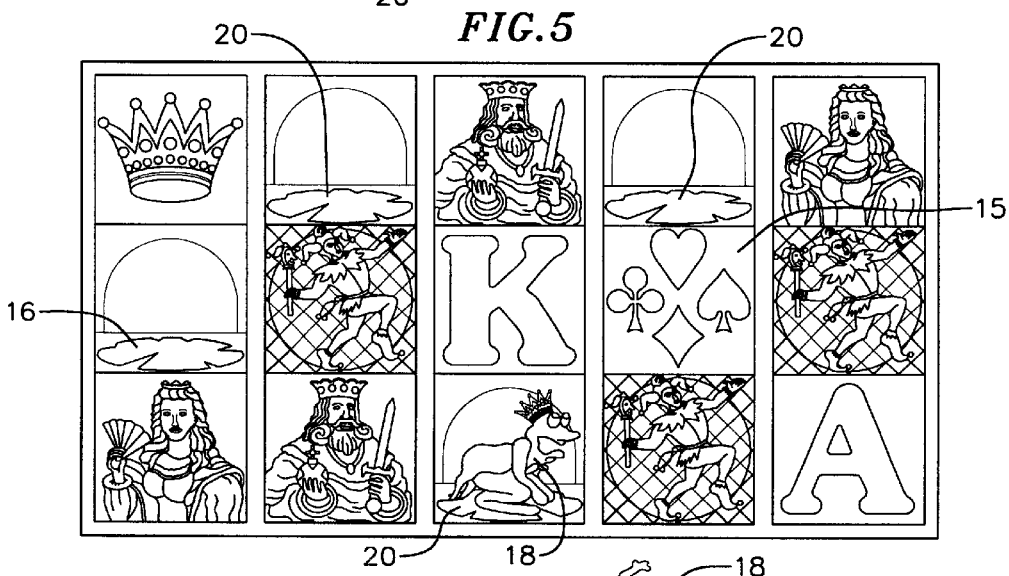
Figure 6:
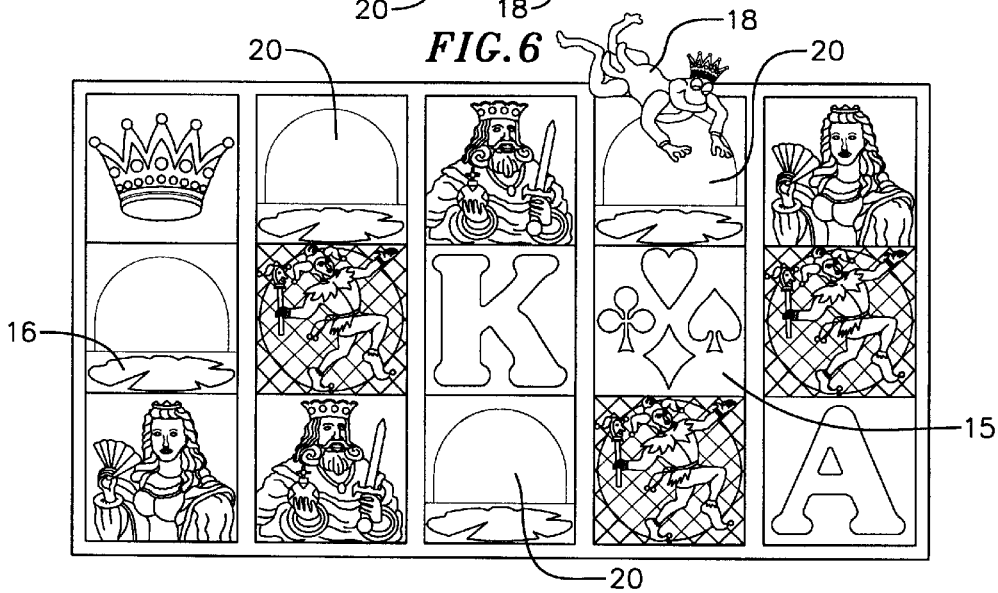
Figure 7:
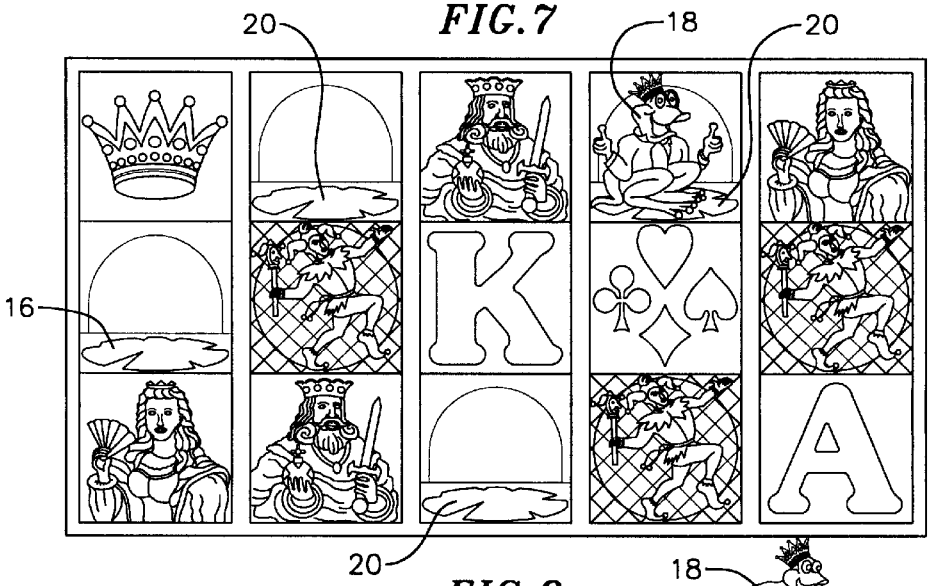
Figure 8:
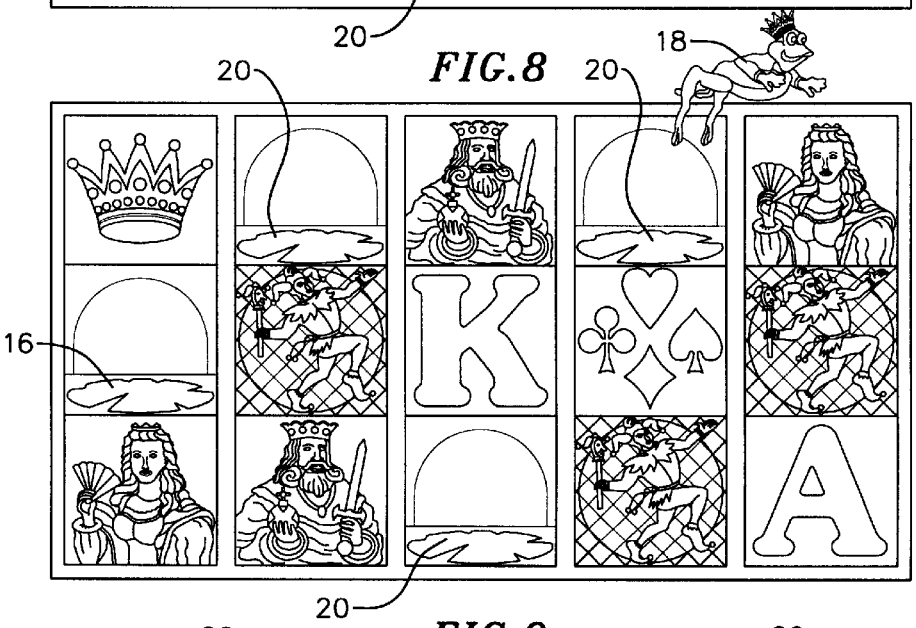

Depending upon the combination of symbols along the paylines 13*a–e*, or on the display 10, the player loses or receives one or more rewards for the play of the primary game. If, the designated reel 12*a* containing the bonus symbol 16 is displayed with the adjacent reel 12*b* having a landing symbol 20, e.g. they are on adjacent reels 12*a,b*, a bonus sequence is triggered for the play of the game. As illustrated in the drawings, with reference to FIG. 2, this condition has been obtained with the bonus symbol 16 being on reel 12*a* and a landing symbol 20 being on reel 12*b*. For play of the game according to the preferred embodiment, alignment of the bonus and landing symbols 16, 20 along any payline 22*a–e* is not required. All that is required is that they appear on adjacent reels 12*a–e* on the display 10. When the bonus condition is sensed by the processor, the bonus sequence is triggered for the game. According to this sequence as shown in FIG. 2, the processor controls the display to show the feature symbol 18 jumping across the display to the landing symbol 20. If the third reel 12*c* includes a landing symbol 20, e.g. the lily pad, the feature symbol 18 would also progress to that landing symbol 20 on the reel 12*c*. However as shown in FIG. 3, reel 12*c* does not include a landing symbol 20. If this condition is sensed by the processor, the processor controls the display 10 to simulate re-spinning of the reels 12*c–e* to obtain a presentation of randomly selected symbols 14 therefor. If one of the symbols of the reel 12*c* after re-spinning is simulated is a landing symbol 20, as shown in the drawings, the feature symbol 18 progresses from reel 12*b* to reel 12*c*. If the fourth reel 12*d* included a landing symbol 20, e.g. the lily pad, the feature symbol 18 would also progress to that landing symbol 20 on the reel 12*d*, and then to any further landing symbol 20 that may be displayed on the fifth reel 12*e*. On the other hand, if the re-spinning of reel 12*c* did not result in the display of a landing symbol 20, e.g. the lily pad, the processor would sense that condition and control the display 10 to show a terminating sequence depicting the landing symbol 18 either not progressing further or jumping or falling from the display 10.

Figure 9:
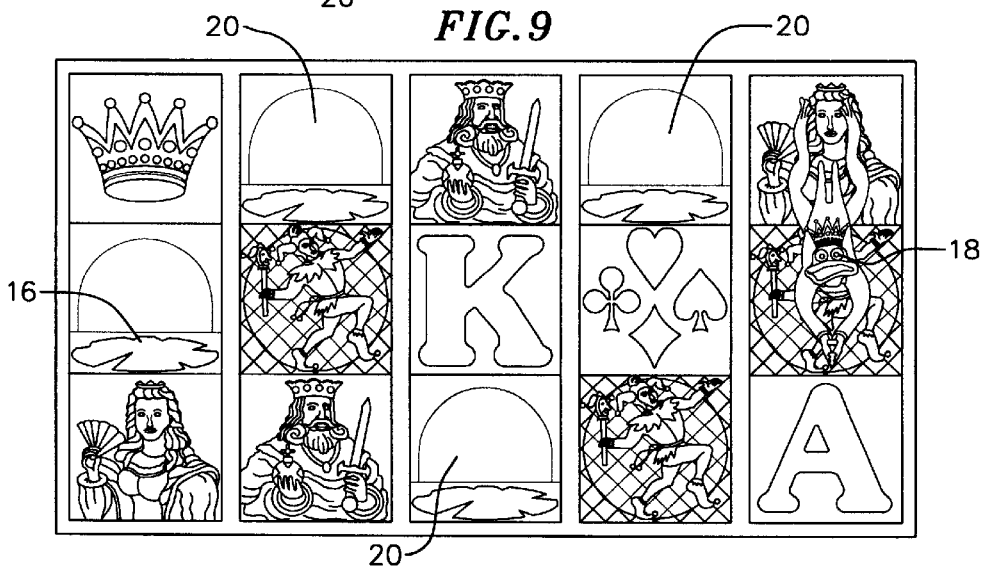

The foregoing sequence continues with the remaining reels 12*d,e* as shown in FIGS. 5–10 until either the feature symbol 18 makes it across all of the reels 12*a–e* or the terminating sequence is initiated to show, for example, the feature symbol 18 falling off of the display 10 due to the lack of presentation of a landing symbol 20 on any right adjacent reels 12*d,e* after re-spinning. As shown in FIG. 9 where the final reel 12*e* does not display a landing symbol 20, the feature symbol 18 is displayed diving from the display 10.

It is to be noted that the re-spinning of the reels 12*c–e*, if required, provides the player with the opportunity to obtain a landing symbol 20 where none existed before. This maintains the players attention in the game as well as increases the excitement as the player watches the progress of the feature symbol 18 across the display 10.

Depending upon how many reels 12*a–e* the feature symbol 18 can progress, the player is provided with a bonus. For example, if the feature symbol 18 can only progress to reel 12*b*, the player receives a bonus of five units. If the feature symbol 18 can progress to reel 12*c*, the player receives a bonus of 10 units. If the feature symbol 18 can progress to reel 12*d*, the player receives a bonus of 20 units and if the feature symbol 18 progresses across all of the reels 12*a–e*, the player receives a bonus of 100 credits.

Figure 10:
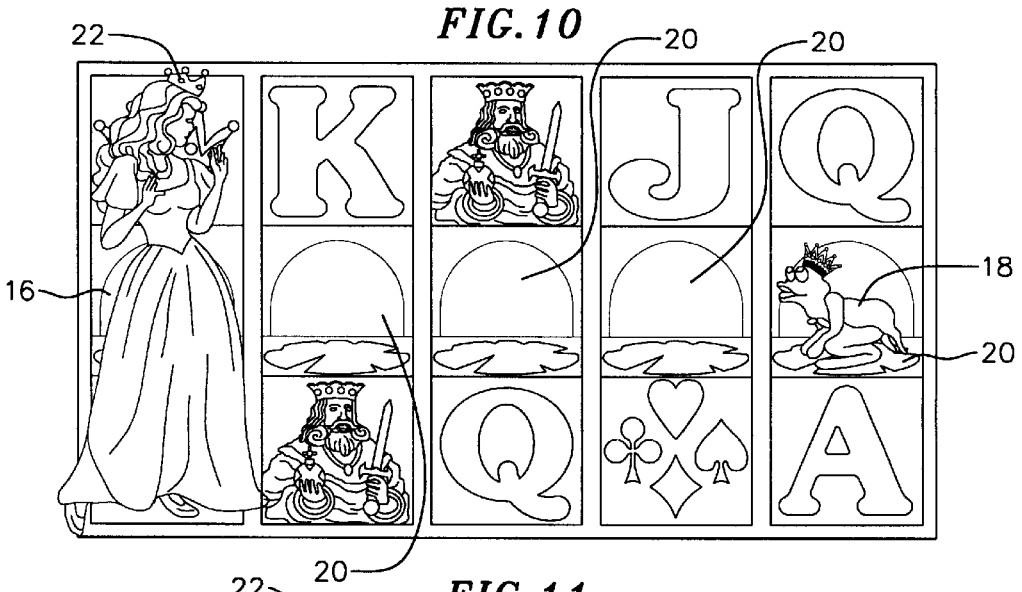
Figure 11:
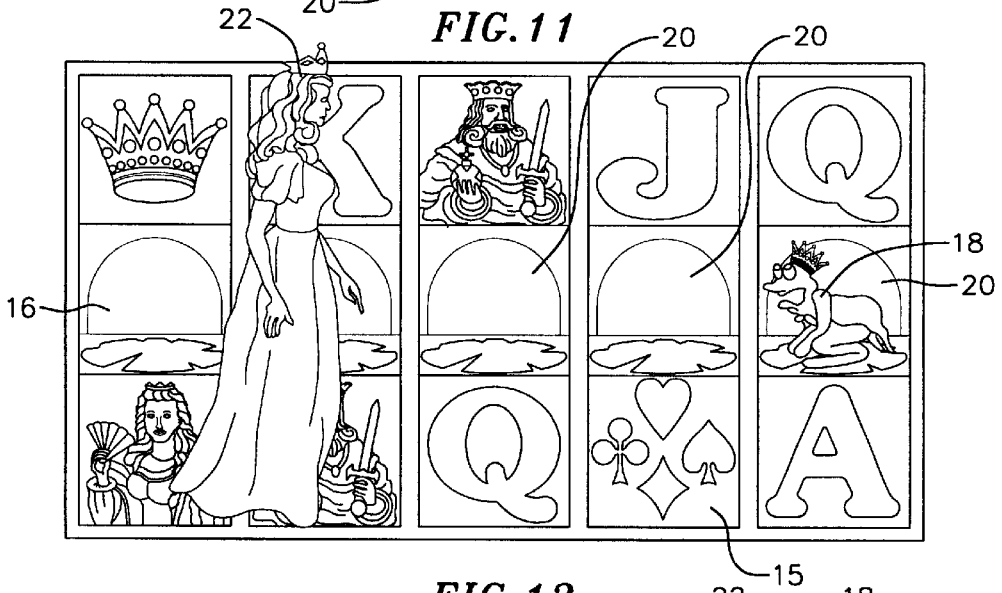
Figure 12:
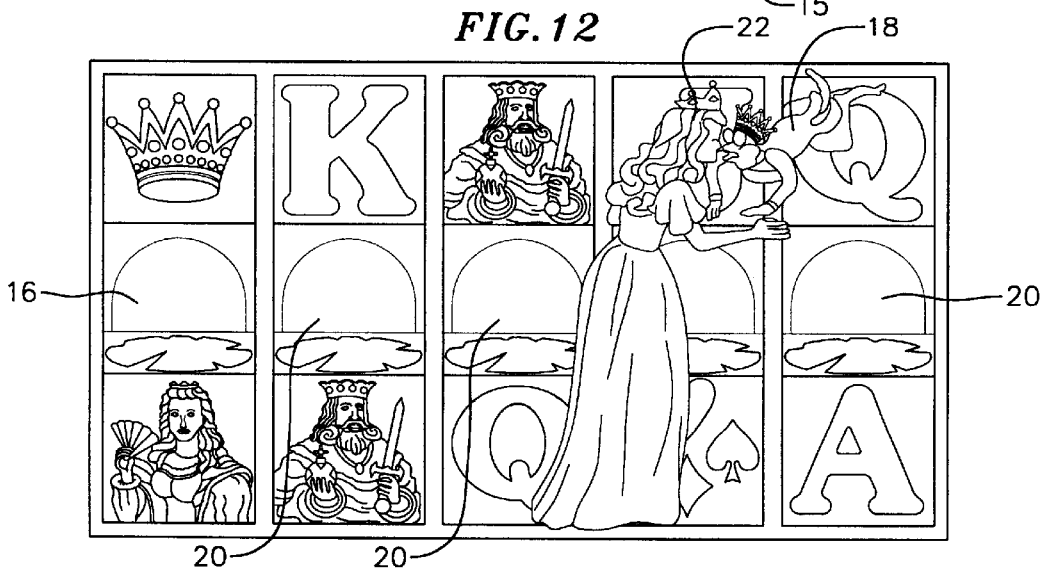

As shown in FIGS. 10–12, a further feature of the game is that if the feature symbol 18 can progress across all of the reels 12*a–e* in the manner described above, the processor senses this condition and controls the display 10 to provide a bonus celebration display which may display, for example, a Princess 22 progressing across the display 10 to kiss the feature symbol 18 which is a frog.

After all winning combinations along the paylines 22*a–e* and the winning combinations for the scattered symbol 15 have been resolved and any bonuses have been rewarded, play is concluded. To play another game, the player must deposit another wager.

Figure 13:
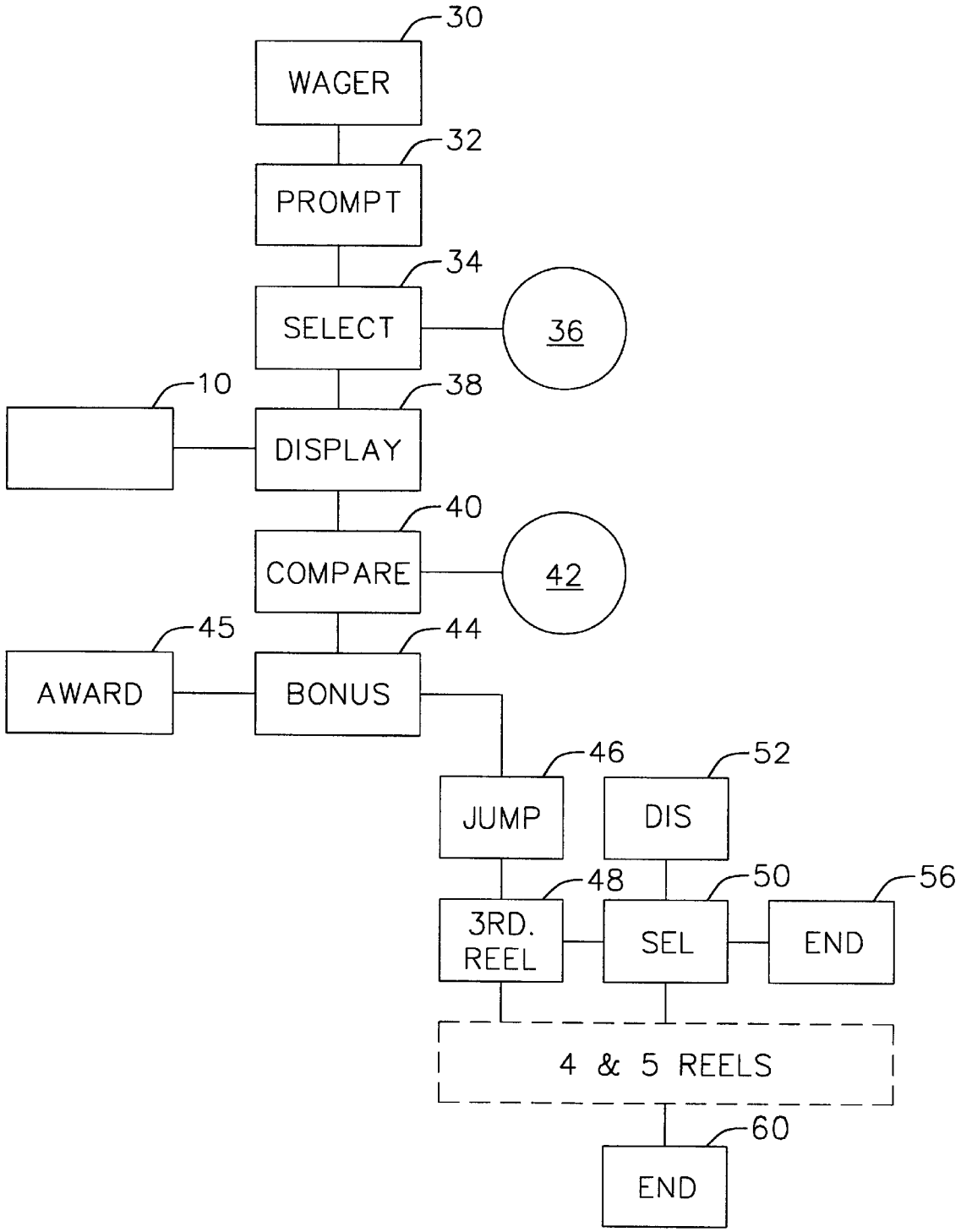
FIG. 13 is a logic diagram for the play of the game.

With reference to FIG. 13, a logic diagram for play of the game is shown. At 30 the player inputs their wager to play the game and at 32 prompts play. The computer processor, when prompted, at 34 selects from a first data structure 36 the symbols 14, 16, 20 to be displayed at the display 10 defining the outcome(s) along the paylines 22*a–e*. The first data structure 36 may contain the universe of symbols weighted in such a manner as to simulate their distribution around the periphery of the virtual reels 12*a–e* or may contain listings of symbol combinations representing a segment a virtual reels 12*a–e*. After the symbols have been selected at 34, the processor at 38 initiates a first display sequence where the reels 12*a–e* are shown as simulating rotation and in a second condition where they slow and stop to define the outcome(s) for the game. The processor at 40 compares the symbols 14, 16, 20 and their location at the display 10 in reference to the paylines 22*a–e* to a predetermined schedule outcomes contained for example in a second data structure 42. The second data structure 42 may contain the combinations referenced above in Table 1. If a correspondence exists, the processor issues reward(s) for any such combinations along any paylines 22*a–e* and for the scattered symbols 15. The processor at 44 compares the outcome displayed at the display 10 to determine whether or not a bonus initiating and bonus and landing symbols 16,20 are in positions so as to initiate a bonus sequence. If they are not in position to trigger a bonus sequence, the game is over and any rewards from the primary game are issued to the player at 45. If, a bonus sequence is initiated by having, for example, the bonus symbol 16 on reel 12*a* and the landing symbol 20 in reel 12*b*, the processor controls the display at 46 to show the feature symbol 18 moving from reel 12*a* to the landing symbol 20 on reel 12*b*. At 48, the processor also senses whether or not a landing symbol 20 appears on the third reel, 12*c*. If not, at 50, the processor controls the display 10 to simulate rotation of the third reel 12*c*, the fourth reel 12*d* and the fifth reel 12*e*, and also selects, in the manner described above, symbols 14. The third, fourth and fifth reels 12*c–e* are shown to slow and stop to redisplay any selectable combinations of symbols at 52. At this position, the processor compares the symbols for the third reel 12*c* to determine whether or not a landing symbol 20 appears thereon. If not, the processor controls the display 10 to simulate an terminating sequence 56 displaying the feature symbol 18 falling from the display 10. If, however, a landing symbol 20 is displayed, the processor senses this condition and controls the display 10 to depict the feature symbol 18 moving from the second reel 12*b* to the third reel 12*c*. At 52, the processor also senses whether or not a landing symbol 20 appears on the fourth reel 12*d*. This sequence continues until either a reel 12*d,e* does not either initially or when respun, display a landing symbol 20 at which time the feature symbol 18 is depicted to move off of the display 10 or the feature symbol 18 progresses entirely across the display from reel to reel 12*a–e*.

The processor senses the progress of the feature symbol 18 and determines its last position before either being removed from the display 10 or making it entirely across all of the reels 12*a–e*. Based upon the position obtained by the feature symbol 18, the processor controls the device 10 to issue the appropriate reward at 60.

In the instance where the feature symbol 18 can progress entirely across the display 10 jumping on all of the reels 12*a–e*, a bonus ending sequence is initiated by the processor whereupon a Princess 22 is shown progressing across the display 10 to kiss the feature symbol frog.

While I have shown and described the game and method where a bonus results in a fixed payout it should be understood that the bonus could also be presented as a multiplier for any award(s) received for outcome(s) from the primary game. Further any suitable triggering event may be used to trigger the bonus sequence. For example, a separate signal may be sent to the game from a separate processor such as a player tracking computer or machines link controller computer, may be sent to trigger the bonus sequence. Also any suitable terminating event may be used to terminate the bonus sequence. For example, a time limit within other or additional conditions may need to be met before the feature symbol can progress along the reels. Additionally a combination of other game symbols could be used to trigger the bonus sequence and a combination of other game symbols could be used to terminate the bonus sequence.

While I have shown and described certain embodiments of the present invention, it is to be understood that it is subject to many changes and modifications without departing from the spirit and scope of the appended claims. For example, as stated above, the jumping symbol could be any other symbol consistent with the theme and overall presentation of the game.

I claim:

1. An improved electronic gaming device of the type including a display, means for accepting a wager, a processor programmed to, when prompted, control the display to display at least three reels each in a spinning mode concluding at a stopped mode whereat a plurality of reel symbols are displayed on said reels defining a winning or a losing outcome based on the combination of symbols displayed on said reels and means for issuing a reward to the player when a winning outcome is obtained, the improvement comprising:

said processor adapted to sense the occurrence of a predetermined bonus triggering event;

designating a symbol as a feature symbol and another symbol as a landing symbol;

in response to sensing said triggering event said processor adapted to initiate a bonus sequence and control the display to display the feature symbol at a first position and move the feature symbol from the first position to at least one or more positions on the display associated with any displayed landing symbols;

wherein said processor is adapted to confine a selected feature symbol to be displayed to at least one reel and any selected landing symbol to other reels, said processor further adapted to, when a bonus triggering event is sensed, sense the absence of a landing symbol displayed for a said other reel and to re-select and display symbols for said other reel including any landing symbol, if any; and means for issuing an award based upon the landing symbols moved to by said feature symbol and disregarding for the award any symbol combinations formed by the moving feature symbol.

2. The improved device of claim 1 including said processor controlling the display to move the feature symbol to a landing symbol displayed as a result of said re-selection.

3. An improved electronic gaming device of the type including a display, means for accepting a wager, a processor programmed to, when prompted, control the display to display at least three reels each in a spinning mode concluding at a stopped mode whereat a plurality of reel symbols are displayed on said reels defining a winning or a losing outcome based on the combination of symbols displayed on said reels and means for issuing a reward to the player when a winning outcome is obtained, the improvement comprising:

said processor adapted to sense the occurrence of a predetermined bonus triggering event;

designating at least one symbol as a landing symbol;

said processor is adapted to confine a selected feature symbol to be displayed to at least one reel and any selected landing symbol to other reels;

in response to sensing said triggering event said processor adapted to initiate a bonus sequence and control the display to display a feature symbol on a first position and move the feature symbol from the first position to at least one or more landing positions on the display associated with other displayed game symbols;

said processor adapted to sense the absence of a landing symbol displayed for a said other reel and to re-select and display symbols for said other reel including any landing symbol, if any;

said processor adapted to sense the absence of a landing symbol at any other reel after said re-selection and to control the display to display a terminating display sequence; and means for issuing an award based upon landing positions moved to by said feature symbol.

4. The improved device of claim 3 including said processor adapted to control the display to display a celebration display sequence wherein a celebration symbol is displayed to interact with the feature symbol.

5. An improved electronic gaming device of the type including a display, means for accepting a wager, a processor programmed to, when prompted, control the display to display at least three reels each in a spinning mode concluding at a stopped mode whereat a plurality of reel symbols are displayed on said reels defining a winning or a losing outcome based on the combination of symbols displayed on said reels and means for issuing a reward to the player when a winning outcome is obtained, the improvement comprising:

said processor adapted to sense the occurrence of a predetermined bonus triggering event;

designating a symbol as a feature symbol and another symbol as a landing symbol;

in response to sensing said triggering event said processor adapted to initiate a bonus sequence and control the display to display the feature symbol at a first position and move the feature symbol from the first position to at least one or more positions on the display associated with any displayed landing symbols;

said processor programed to control the display to display a selected feature symbol to the left most reel of the display and any selected landing symbol to the remaining reels, said processor further adapted to sense the display of said feature symbol with a landing symbol displayed on an adjacent reel to define said triggering event whereupon the display is controlled to move the feature symbol to the landing symbol, said processor sensing the condition of the presence of a landing symbol on the next adjacent reels and if a landing symbol is displayed to control the display to display the feature symbol moving to the landing symbol on the said reels and to the said remaining reels that meet the said condition and said processor further adapted to sense the absence of a displayed landing symbol on the remaining reels and to re-select and display symbols for said other reel including any landing symbol, if any; and means for issuing an award based upon the landing symbols moved to by said feature symbol and disregarding for the award any symbol combinations formed by the moving feature symbol.

6. An improved electronic gaming device of the type including a display, means for accepting a wager, a processor programmed to, when prompted, control the display to display at least three reels each in a spinning mode concluding at a stopped mode whereat a plurality of reel symbols are displayed on said reels defining a winning or a losing outcome based on the combination of symbols displayed on said reels and means for issuing a reward to the player when a winning outcome is obtained, the improvement comprising:

said processor adapted to sense the occurrence of a predetermined bonus triggering event;

designating at least one symbol as a landing symbol;

said processor controlling the display to display a selected feature symbol to the left most reel of the display and any selected landing symbol to the remaining reels, said processor further adapted to sense the display of said feature symbol with a landing symbol displayed on an adjacent reel to define said triggering event whereupon the display is controlled to move the feature symbol to the landing symbol, said processor sensing the condition of the presence of a landing symbol on the next adjacent reels and if a landing symbol is displayed to control the display to display the feature symbol moving to the landing symbol on the said reels and to the said remaining reels that meet the said condition;

said processor adapted to sense the absence of a displayed landing symbol on the remaining reels and to re-select and display symbols for said other reel including any landing symbol, if any; and said processor adapted to sense the absence of a landing symbol on any remaining reels and in response thereto control the display to display a bonus terminating sequence.

7. An improved electronic gaming device of the type including a display, means for accepting a wager, a data structure storing data representing game symbols, a processor programmed to, when prompted, control the display to display at least three reels each in a spinning mode concluding at a stopped mode whereat a plurality of symbols are displayed on said reels selected from the data structure defining a winning or a losing outcome and means for issuing a reward to the player when a winning outcome is obtained, the improvement comprising:

said data structure includes for at least one selected reel a bonus initiating symbol and for the other reels a bonus enabling symbol;

said processor is adapted to sense, when the device is at the stopped mode, the display of said initiating symbol and a bonus enabling symbol on a reel adjacent to said selected reel and in response thereto initiate a bonus sequence including controlling the display to (a) sequentially move the bonus initiating symbol from the selected reel to a position associated with said enabling symbol on adjacent reels, (b) if any adjacent reel does not display an enabling symbol to control the display to display said reel in a spinning mode concluding in the display of said symbols including, in any, bonus initiating symbol; and means for issuing a reward based upon the number of adjacent reels the bonus initiating symbol moves to.

8. The improved device of claim 7 wherein said selected reel is the leftmost reel at the display.

9. The improved device of claim 7 including said processor preprogrammed to display at least four reels.

10. The improved device of claim 7 including said processor preprogrammed to execute a first animated sequence displaying said initiating symbol moving from reel to reel.

11. An improved electronic gaming device of the type including a display, means for accepting a wager, a data structure storing data representing game symbols, a processor programmed to, when prompted, control the display to display at least three reels each in a spinning mode concluding at a stopped mode whereat a plurality of symbols are displayed on said reels selected from the data structure defining a winning or a losing outcome and means for issuing a reward to the player when a winning outcome is obtained, the improvement comprising:

said data structure includes for at least one selected reel a bonus initiating symbol and for the other reels a bonus enabling symbol;

said processor is adapted to sense, when the device is at the stopped mode, the display of said initiating symbol and a bonus enabling symbol on a reel adjacent to said selected reel and in response thereto initiate a bonus sequence including controlling the display to (a) sequentially move the bonus initiating symbol from the selected reel to a position associated with said enabling symbol on adjacent reels, (b) if any adjacent reel does not display an enabling symbol to control the display to display said reel in a spinning mode concluding in the display of said symbols including, in any, bonus initiating symbol; and means for issuing a reward based upon the number of adjacent reels the bonus initiating symbol moves to;

said processor preprogrammed to execute a first animated sequence displaying said initiating symbol moving from reel to reel; and said processor preprogrammed to execute a second animated sequence displaying said initiating symbol moving off the display where said processor senses that no enabling symbol appears on an adjacent reel.

12. A method for a player to play an electronic gaming device comprising:

providing a display;

providing a computer processor to control said display;

the player making a wager and prompting play of the game;

said processor in response to the player prompting play controlling the display to display at least three reels in a spinning mode concluding at a stop mode where said display displays game symbols for each reel defining a winning or a losing outcome for the game;

rewarding the player for obtaining a winning outcome;

if one of the reels in the stop mode displays a designated bonus initiating symbol and an adjacent reel displays a designated bonus enabling symbol, said processor controlling the display to display said initiating symbol moving to the adjacent reel;

if any of the remaining reels in the stop mode do not display an initiating symbol, said processor controlling the display to re-spin said remaining reels at least once to a stop position to display said symbols including any enabling symbol; and issuing a reward to the player based upon the number of reels the enabling symbol moves to.

13. An improved electronic gaming device of the type including a display, means for accepting a wager, a processor programmed to, when prompted, control the display to display at least three reels each in a spinning mode concluding at a stopped mode whereat a plurality of reel symbols are displayed on said reels defining a winning or losing outcome based on the combination of symbols displayed on said reels and means for issuing a reward to the player when a winning outcome is obtained, the improvement comprising:

said processor is programmed to sense the outcome of a bonus triggering event, such outcome being characterized in that the display displays a feature symbol and at least one or more landing symbols and in response to sensing such a condition initiate a bonus sequence to control the display to display the feature symbol moving from its initial position toward each displayed landing symbol, said processor further determining the number of landing symbols moved to by the feature symbol;

means for issuing an award based upon the number of landing symbols moved to by said feature symbol and disregarding for the award any symbol winning combinations.

14. The improved device of claim 13 including said processor programmed to confine said feature symbol to one reel and the landing symbols to other reels.

15. An improved electronic gaming device of the type including a display, means for accepting a wager, a processor programmed to, when prompted, control the display to display at least three reels each in a spinning mode concluding at a stopped mode whereat a plurality of reel symbols are displayed on said reels defining a winning or losing outcome based on the combination of symbols displayed on said reels and means for issuing a reward to the player when a winning outcome is obtained, the improvement comprising:

said processor is programmed to sense the outcome of a bonus triggering event, such outcome being characterized in that the display displays a bonus symbol and at least one or more landing symbols and in response to sensing such a condition initiate a bonus sequence to control the display to display a feature symbol moving from its initial position that coincides with the bonus symbol position, toward each displayed landing symbol, said processor further determining the number of landing symbols moved to by the feature symbol; and means for issuing an award based upon the number of landing symbols moved to by said feature symbol and disregarding for the award any symbol winning combinations.

* * * * *